US010717294B2

(12) United States Patent
Shimizu

(10) Patent No.: US 10,717,294 B2
(45) Date of Patent: Jul. 21, 2020

(54) WASTE INK CASE AND PRINTER

(71) Applicant: CASIO COMPUTER CO., LTD., Shibuya-ku, Tokyo (JP)

(72) Inventor: Daisuke Shimizu, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/241,911

(22) Filed: Jan. 7, 2019

(65) Prior Publication Data

US 2019/0210376 A1 Jul. 11, 2019

(30) Foreign Application Priority Data

Jan. 9, 2018 (JP) ..... 2018-000940

(51) Int. Cl.

| | |
|---|---|
| ***B41J 2/185*** | (2006.01) |
| ***B41J 2/17*** | (2006.01) |
| ***B41J 2/165*** | (2006.01) |
| ***B41J 29/02*** | (2006.01) |

(52) U.S. Cl.

CPC ..... *B41J 2/185* (2013.01); *B41J 2/165* (2013.01); *B41J 2/16511* (2013.01); *B41J 2/16526* (2013.01); *B41J 2/16538* (2013.01); *B41J 2/1721* (2013.01); *B41J 29/02* (2013.01); *B41J 2002/1856* (2013.01)

(58) Field of Classification Search

CPC ... B41J 2/1721; B41J 29/02; B41J 2/18; B41J 2002/1856; B41J 2/165; B41J 2/185; B41J 2/16511; B41J 2/16526; B41J 2/16538

See application file for complete search history.

(56) References Cited

U.S. PATENT DOCUMENTS

| | | | | |
|---|---|---|---|---|
| 2003/0067521 A1* | 4/2003 | Kaga | ..... | B41J 2/1721 347/86 |
| 2014/0176643 A1* | 6/2014 | Komaki | ..... | B41J 2/1721 347/36 |

FOREIGN PATENT DOCUMENTS

| | | |
|---|---|---|
| JP | H07144413 A | 6/1995 |
| JP | H11198413 A | 7/1999 |
| JP | 2007021726 A | 2/2007 |

* cited by examiner

*Primary Examiner* — Jannelle M Lebron
(74) *Attorney, Agent, or Firm* — Holtz, Holtz & Volek PC

(57) ABSTRACT

A waste ink case includes a container. The container houses an ink absorber that absorbs ink. The container includes an ink introducing port, an exhaust vent, and a partition wall. Through the ink introducing port, the ink is introduced from a print head into the container. Through the exhaust vent, air in the container is exhausted. The partition wall acts as an obstruction between the ink introducing port and the exhaust vent. The ink absorber is provided along a ventilation passage. The ventilation passage is from the ink introducing port to the exhaust vent, detouring around the partition wall.

8 Claims, 4 Drawing Sheets

WASTE INK CASE AND PRINTER

CROSS-REFERENCE TO RELATED APPLICATIONS

This application is based upon and claims the benefit of priority under 35 U.S.C. 119 of Japanese Patent Application No. 2018-000940 filed on Jan. 9, 2018 the entire disclosure of which, including the description, claims, drawings, and abstract, is incorporated herein by reference in its entirety.

BACKGROUND OF THE INVENTION

1. Field of the Invention

The present invention relates to a waste ink case and a printer.

2. Description of the Related Art

There is known an inkjet drawing apparatus (inkjet printer) which makes ink into fine droplets and ejects the fine droplets from an ink ejection surface, thereby performing drawing on a drawing target.

The inkjet drawing apparatus performs a purging process of forcibly ejecting ink from the ink ejection surface into a waste ink case. This purging process sweeps away, by and with the ink, air bubbles, impurities and so forth adhered to or flowed into nozzles and the ink ejection surface, which solves a problem of poor ink ejection. (Refer to, for example, JP 2007-021726 A.)

In a conventional waste ink case, an ink absorber is housed in a tightly covered-up container having an opening part formed as an ink entrance, and ink is ejected to the ink absorber through the opening part. However, this structure has nowhere, except the opening part, for air in the container to escape, and causes the ink to flow backward through the opening part.

Hence, for example, in a waste ink case described in JPH 11-198413 A, in addition to an opening part as an ink entrance, an exhaust vent for air in the waste ink case to escape is formed. This can exhaust the air in the waste ink case through the exhaust vent, and can prevent the ink from flowing backward through the opening part.

SUMMARY OF THE INVENTION

Objects of the present invention include providing a waste ink case which can make an ink absorber therein properly absorb ink, and a printer including this waste ink case.

According to an embodiment of the present invention, there is provided a waste ink case including: a container which houses an ink absorber that absorbs an ink, and includes: an ink introducing port through which the ink is introduced from a print head into the container; an exhaust vent through which an air in the container is exhausted; and a partition wall which acts as an obstruction between the ink introducing port and the exhaust vent, wherein the ink absorber is provided along a ventilation passage from the ink introducing port to the exhaust vent, detouring around the partition wall.

According to another embodiment of the present invention, there is provided a printer including: a waste ink case including: a container which houses an ink absorber that absorbs an ink, and includes: an ink introducing port through which the ink is introduced from a print head into the container; an exhaust vent through which an air in the container is exhausted; and a partition wall which acts as an obstruction between the ink introducing port and the exhaust vent, wherein the ink absorber is provided along a ventilation passage from the ink introducing port to the exhaust vent, detouring around the partition wall; and a partition plate vertically provided so as to cover the exhaust vent, having a gap between the partition plate and the exhaust vent.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention, wherein.

DETAILED DESCRIPTION OF THE INVENTION

Figure 1:
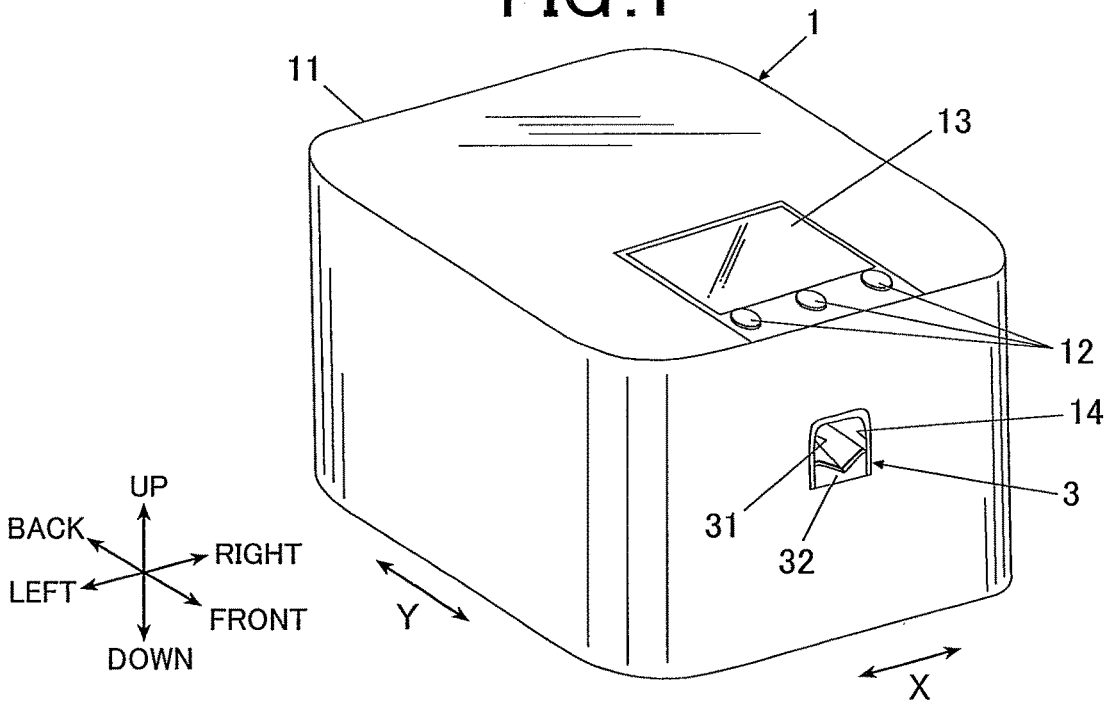
FIG. 1 is a perspective view showing external appearance/configuration of a nail printer according to an embodiment(s)

An embodiment(s) of a waste ink case and a printer (drawing apparatus) of the present invention will be described with reference to FIG. 1 to FIG. 6B.

The embodiment described below is provided with various limitations technically preferable for carrying out the present invention. However, the scope of the present invention is not limited to the embodiment below or illustrated examples.

Further, in the embodiment below, a nail printer which performs drawing on nails of fingers as drawing target(s) is described as an example of the printer. However, the drawing target of the printer of the present invention is not limited to nails of fingers. For example, nails of toes may be the drawing target. Other than nails, nail tips and surfaces of various accessories may also be the drawing target.

FIG. 1 is a perspective view showing external appearance/configuration of the nail printer 1 according to this embodiment.

As shown in FIG. 1, the nail printer 1 of this embodiment has a case 11 which is formed to be approximately box-shaped.

On the upper surface (top) of the case 11, an operation unit 12 is installed.

The operation unit 12 is an input unit for a user(s) to make various inputs.

On the operation unit 12, operation buttons to make various inputs are arranged. Examples of the operation buttons include a power button to turn on the power of the nail printer 1, a stop button to stop operation of the nail printer 1, a design selection button to select a design image to be drawn on a nail(s), and a drawing start button to make an instruction to start drawing.

On the upper surface (top) of the case 11, a display 13 is also installed.

The display 13 is constituted of, for example, a liquid crystal display (LCD), an organic electroluminescence display, or another flat display.

In this embodiment, the display 13 displays, as needed, a nail image (finger image including an image of a nail) obtained by imaging a finger, an image of the contour line of the nail included in the nail image, a design selection screen to select a design image to be drawn on the nail, a thumbnail image for design check, an instruction screen which displays various instructions, and so forth.

A touchscreen to make various inputs may be integrated with the surface of the display 13. In this case, the touchscreen functions as the operation unit 12.

On the internal (or lower) side of the upper surface (top) of the case 11, above a window part 33 of a finger holder 3 described below, an imaging mechanism (not shown) is arranged. The imaging mechanism images the nail exposed from the window part 33, thereby obtaining the nail image (image of the finger including the nail).

In the front surface of the case 11, approximately at the center in the right-left direction, an opening part 14 is formed. The opening part 14 is where the finger corresponding to the nail as the drawing target is inserted.

In the opening part 14, as described below, the finger holder 3 is arranged. The finger holder 3 holds and fixes the nail (finger including the nail).

Figure 2:
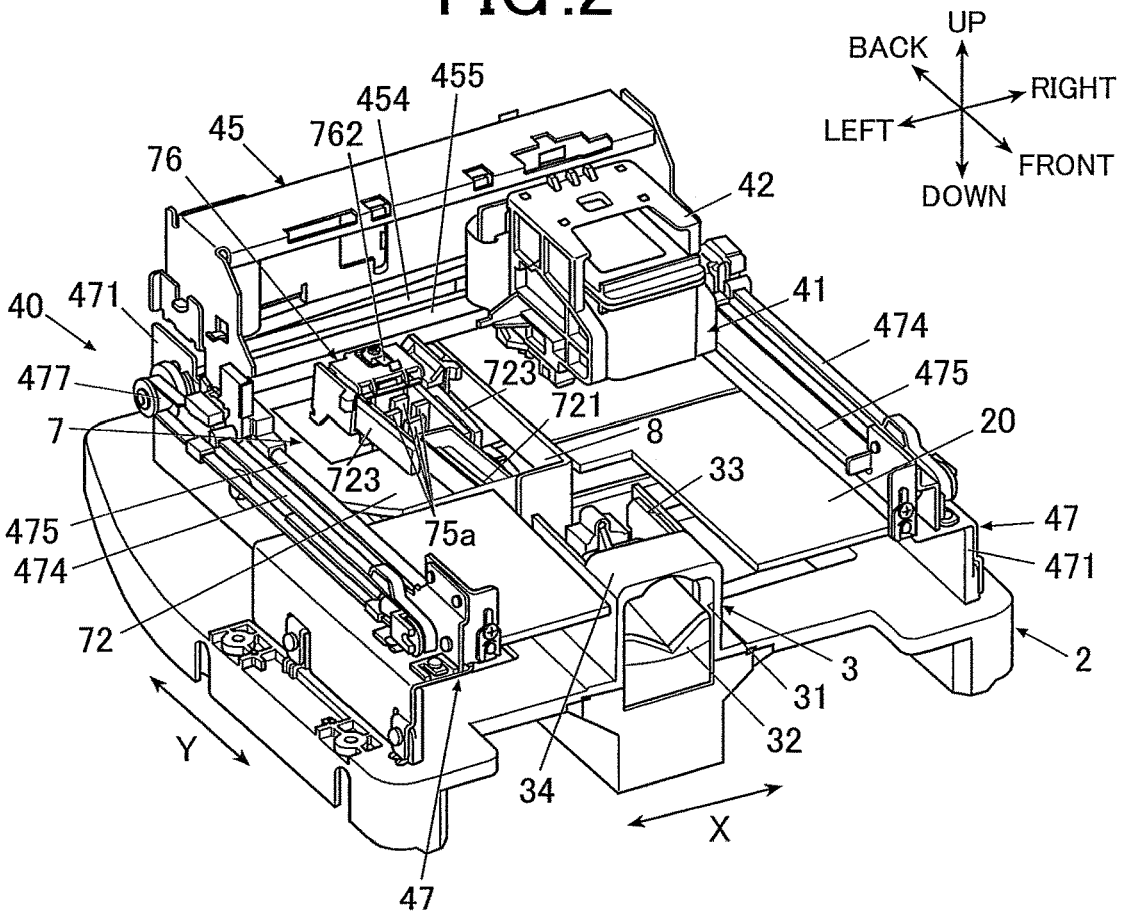
FIG. 2 is a perspective view schematically showing internal configuration of the nail printer according to the embodiment.

FIG. 2 is a perspective view schematically showing internal configuration of the nail printer 1 by removing the case 11 from the nail printer 1 shown in FIG. 1.

As shown in FIG. 2, in the case 11, abase 2 on which various internal structures (components) are mounted is arranged.

The upper surface of the base 2 is a base upper surface 20 which is approximately flat.

On the front portion of the base upper surface 20, approximately at the center in the right-left direction, the finger holder 3 is arranged at a position corresponding to the opening part 14 of the case 11.

The finger holder 3 is a box-shaped member having an opening part 31 in the front surface. In the finger holder 3, a finger holding member 32 which holds and fixes the finger is arranged.

The finger holding member 32 pushes and supports the finger from underneath, and is formed of, for example, flexible resin. In this embodiment, the finger holding member 32 is shaped to be concave approximately at the center in the width direction (right-left direction), and receives the ball of the finger when the finger is placed on the finger holding member 32, thereby preventing the finger from being unsteady in the right-left direction.

The back (or deep) portion of the upper surface of the finger holder 3 is opened and forms the window part 33. From the window part 33, the nail of the finger inserted into the finger holder 3 is exposed.

In this embodiment, the region where the window part 33 is arranged is a drawing region 21 (shown in FIG. 3) where a drawing mechanism 40 described below performs drawing.

The front portion of the upper surface of the finger holder 3 forms a finger push part 34 which prevents the finger from floating (rising) and limits the position of the finger in the up direction. The finger and its nail are supported by the finger holding member 32 from underneath and pushed by the finger push part 34 from above, so that the finger is positioned at a predetermined position in the height direction.

As shown in FIG. 2, in the case 11, the drawing mechanism 40 which performs drawing on a drawing target surface is arranged. The drawing target surface is the surface of the drawing target, which is, in this embodiment, the surface of the nail of the finger.

The drawing mechanism 40 includes: a drawing head 41 (print head) as the body of the drawing mechanism 40; a head carriage 42 which supports the drawing head 41; an X-direction movement stage 45 which moves the drawing head 41 in X direction which is along the right-left direction; an X-direction movement motor (not shown); a Y-direction movement stage 47 which moves the drawing head 41 in Y direction which is along the front-back direction; a Y-direction movement motor (not shown); and so forth.

The Y-direction movement stage 47 has supporting members 471 arranged at both sides of the base upper surface 20 in the right-left direction. The supporting members 471 extend in the front-back direction.

To both ends in the extending direction of each of the supporting members 471, which form a pair, pulleys 477 are attached. Around the pulleys 477 on the right of the nail printer 1 and around the pulleys 477 on the left thereof, respective drive belts 474 extending in the front-back direction are wounded.

Figure 3:
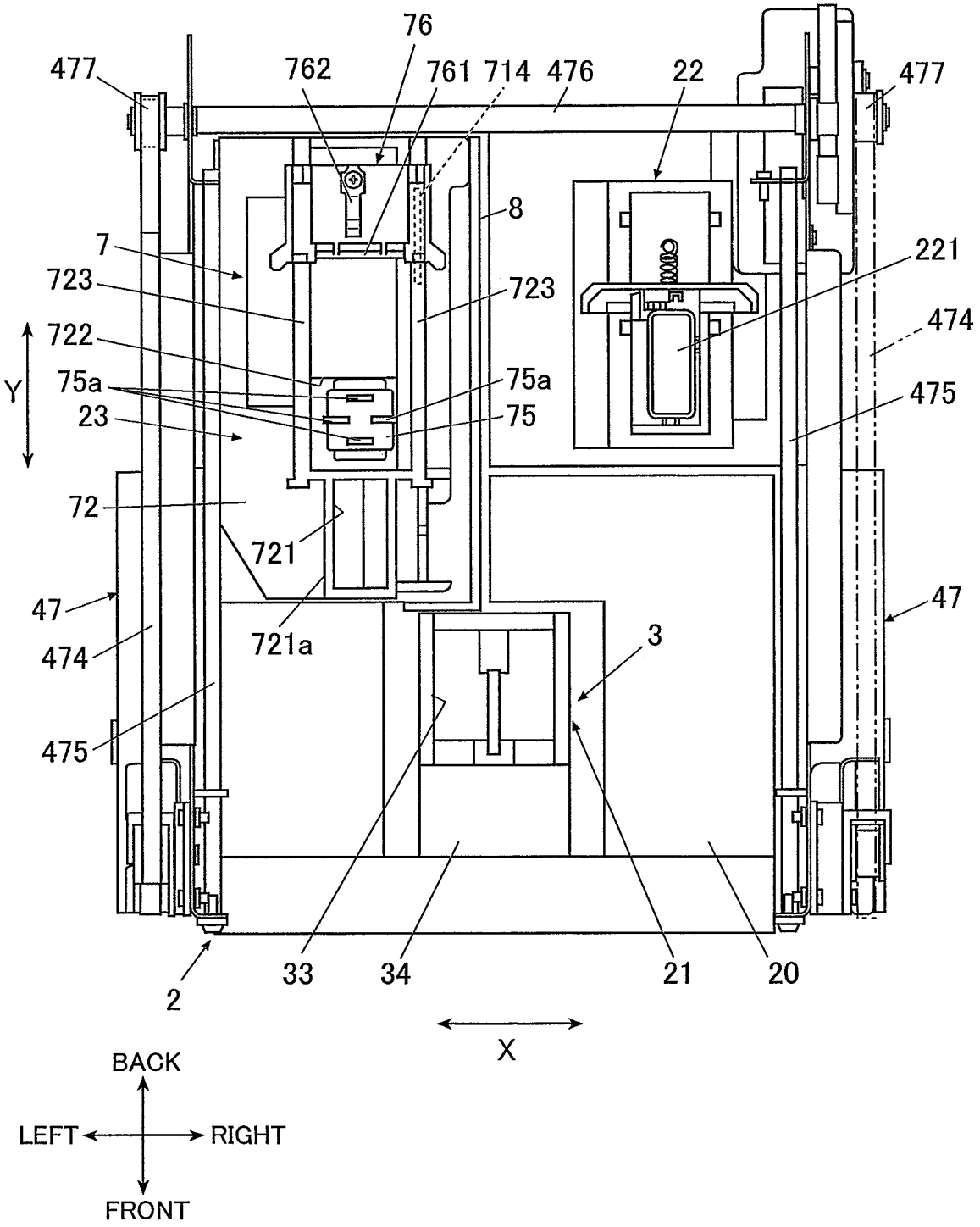
FIG. 3 is a plan view showing configuration of a base of the nail printer according to the embodiment.

The pulleys 477 at the back ends of the nail printer 1 are attached to both ends of a drive shaft 476 (shown in FIG. 3). To the drive shaft 476, the not-shown Y-direction movement motor is connected. When the Y-direction movement motor operates, the drive shaft 476 and the pulleys 477 attached thereto rotate in the normal/opposite rotation direction appropriately.

Rotation of the pulleys 477 rotates the drive belts 474 wounded around the pulleys 477, so that the X-direction movement stage 45 (and the drawing head 41 mounted on the X-direction movement stage 45) can move in the Y direction.

On the supporting members 471, guide shafts 475 extending in the front-back direction are arranged parallel to the drive belts 474.

The X-direction movement stage 45 is formed in the shape of a rectangular box extending in the right-left direction, and arranged at the back end of the base upper surface 20.

Into the right and left ends of the X-direction movement stage 45, the guide shafts 475 are inserted, respectively. When the not-shown Y-direction movement motor operates, the drive belts 474 rotate, so that the X-direction movement stage 45 can move in the Y direction along the guide shafts 475.

In the X-direction movement stage 45, not-shown pulleys are arranged. Around the pulleys, a drive belt 454 extending in the right-left direction is wounded. In the X-direction movement stage 45, a guide shaft 455 extending in the right-left direction is arranged approximately parallel to the drive belt 454.

To the X-direction movement stage 45, the head carriage 42 which supports the drawing head 41 is attached.

On the back surface of the head carriage 42, a not-shown carriage supporting member into which the guide shaft 455 is inserted is arranged.

Thus the guide shaft 455 is inserted into the head carriage 42. When the X-direction movement motor operates, the drive belt 454 rotates, so that the head carriage 42 can move in the X direction along the guide shaft 455 in the X-direction movement stage 45.

The drawing head 41 of this embodiment is an inkjet head which performs drawing by an inkjet method.

The drawing head 41 is an ink-cartridge-integrated head in which not-shown ink cartridges of inks for yellow (Y), magenta (M) and cyan (C) are integrated with an ink ejection surface 411 (shown in FIG. 6A) arranged on, of the respective ink cartridges, surfaces (lower surfaces, in this embodiment) facing the drawing target (surface of the nail). In the ink ejection surface 411, ejection ports (ink ejection ports (not shown)) of nozzle arrays are formed in row(s). Each nozzle array is constituted of a plurality of nozzles from which an ink of a color is ejected. The drawing head 41 makes the inks into fine droplets, and performs drawing by ejecting the ink droplets directly to the drawing target surface of the drawing target (i.e., the surface of the nail) from the ink ejection surface 411 (ink ejection ports of the ink ejection surface 411). The drawing head 41 is not limited to the one which ejects the inks of the above three colors. The drawing head 41 may have an ink cartridge(s) which stores another ink and ink ejection ports therefor.

FIG. 3 is a plan view showing configuration of the base upper surface 20 by removing the X-direction movement stage 45 and the drawing head 41 supported by the head carriage 42 of the drawing mechanism 40.

As shown in FIG. 2 and FIG. 3, on the front portion of the base upper surface 20, approximately at the center in the right-left direction, the finger holder 3 is arranged as described above. In this embodiment, the region corresponding to the window part 33 of the finger holder 3 is the drawing region 21 where the drawing head 41 performs a drawing operation during a drawing period.

Further, the right back portion of the base upper surface 20 forms a standby region 22 where the drawing head 41 is placed during a no-drawing period. The standby region 22 is arranged at a position different from the drawing region 21.

The standby region 22 is provided with a cap 221 which covers the ink ejection surface 411.

The cap 221 protects the ink ejection surface 411 during the no-drawing period from drying or the like, and is formed of, for example, flexible resin.

As shown in FIG. 2 and FIG. 3, the left back portion of the base upper surface 20 forms a maintenance region 23 where maintenance of the drawing head 41 is performed.

In the maintenance region 23, a purging process and a wiping process are performed. The purging process is a process of forcibly ejecting ink from the ink ejection ports of the ink ejection surface 411, thereby, together with the ink, ejecting air, impurities, viscosity-increased ink and so forth in ink flow passages, such as in nozzles, to the outside. The wiping process is a process of wiping the ink ejection surface 411.

In the maintenance region 23, a waste ink case 7 where ink forcibly ejected from the drawing head 41 by the purging process is retained is detachably embedded in the base 2 with the upper surface exposed from the base upper surface 20.

Figure 4:
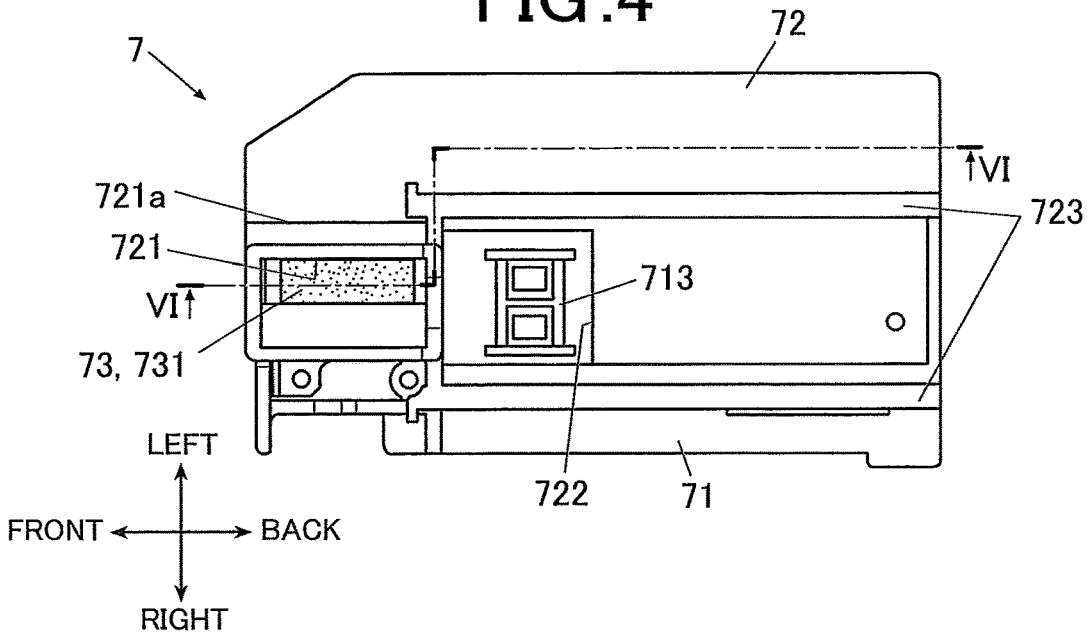
FIG. 4 is a plan view of a waste ink case according to the embodiment.
Figure 5:
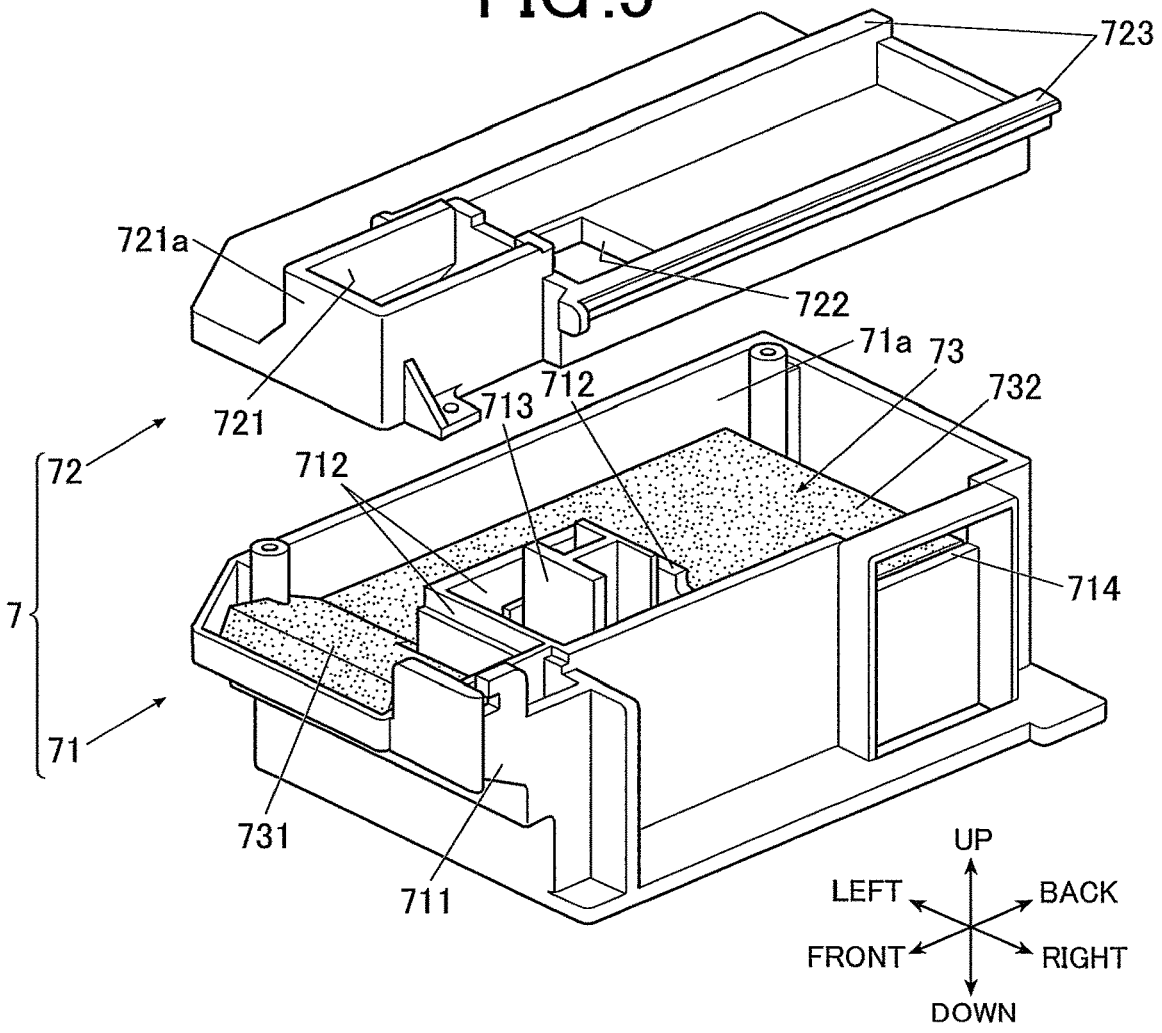
FIG. 5 is an exploded perspective view of the waste ink case according to the embodiment.
Figure 6A:
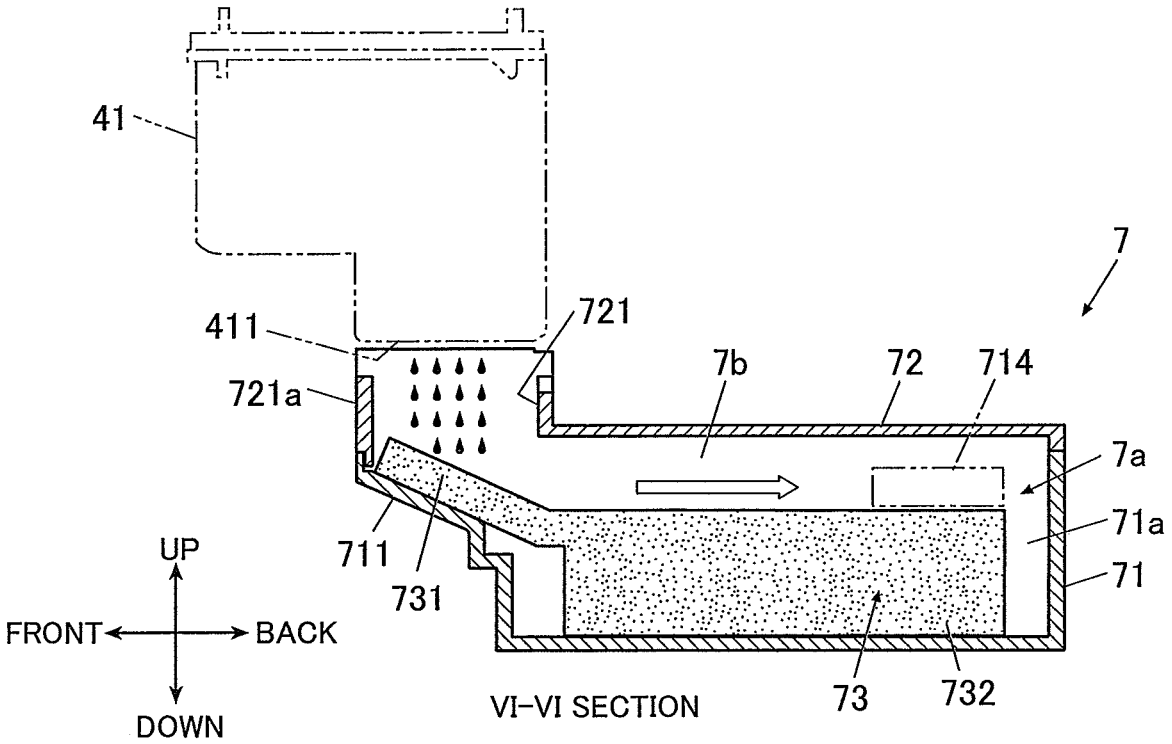
FIG. 6A is a cross-sectional view of the waste ink case taken along VI-VI line in FIG. 4.
Figure 6B:
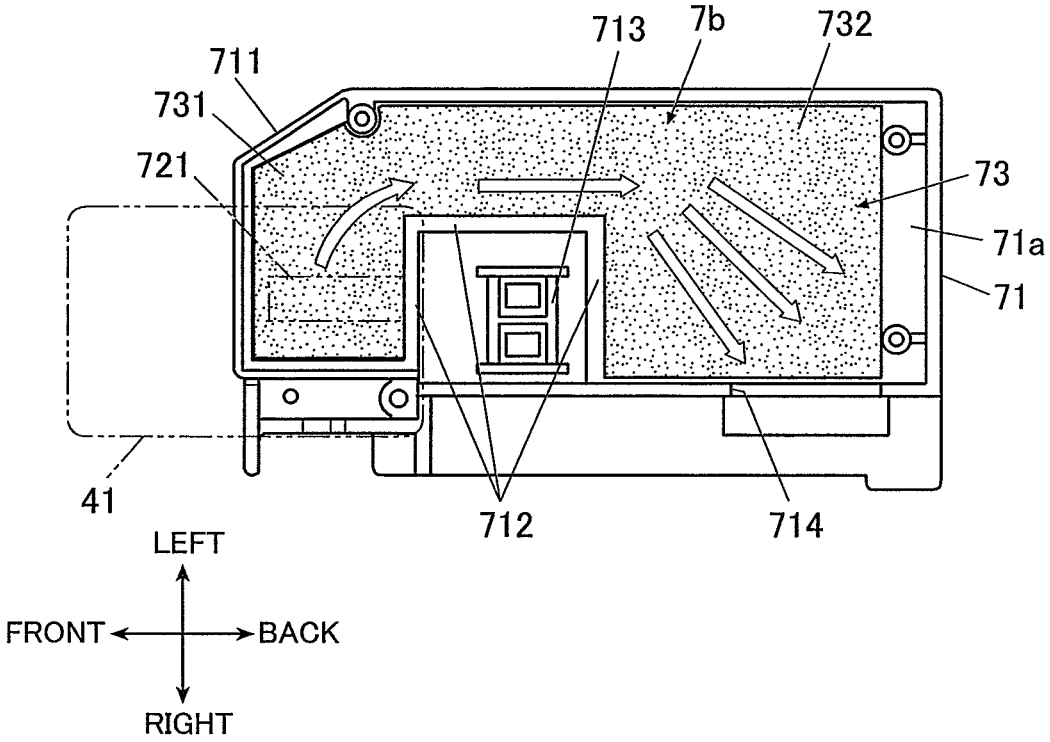
FIG. 6B is a plan view of a case body and an ink absorber of the waste ink case.

FIG. 4 and FIG. 5 are a plan view and an exploded perspective view of the waste ink case 7, respectively. FIG. 6A is a cross-sectional view of the waste ink case 7 taken along VI-VI line in FIG. 4. FIG. 6B is a plan view of, of the waste ink case 7, a case body 71 and an ink absorber 73 described below. In FIG. 4 to FIG. 6B, a wiping member 75 and a scraping unit 76 described below are not shown.

As shown in FIG. 4 and FIG. 5, the waste ink case 7 includes a container including: the case body 71 with the upper surface opened; and a lid member 72 which covers the opening in the upper surface of the case body 71.

The case body 71 is formed to be long in the front-back direction, thereby being approximately rectangular.

The front end portion of the case body 71 forms a taper part 711 configured such that the bottom of the case body 71 is raised to the middle height/level and inclines to be higher at the front end.

In the back upper-end portion of the right wall of the case body 71, an exhaust vent 714 is formed. The exhaust vent 714 makes the inside (ink retaining part 71*a* described below) and the outside of the case body 71 communicate with each other. The exhaust vent 714 is for exhausting air in the waste ink case 7 to the outside when ink is ejected into the waste ink case 7. Preferably, the exhaust vent 714 has an area equivalent (80 to 100%, in this embodiment) to the area of an ink introducing port 721 of the lid member 72 described below.

Through the exhaust vent 714, ink not absorbed by the ink absorber 73 described below may be released in the form of mist and make components outside dirty.

Hence, in this embodiment, on the right side of the waste ink case 7, a partition plate 8 is vertically arranged so as to cover the exhaust vent 714, having a predetermined gap in between. (Refer to FIG. 2 and FIG. 3.) More specifically, the partition plate 8 is vertically arranged on the immediate right of the waste ink case 7 along the front-back direction so as to cover the full length of the waste ink case 7 in the front-back direction.

Preferably, the position and direction/aspect of the exhaust vent 714 are set such that components which hate dirt are not arranged in front of the exhaust vent 714, regardless of the presence or absence of the partition plate 8. For example, in this embodiment, the left surface of the case body 71 (waste ink case 7) faces a moving mechanism (Y-direction movement stage 47, Y-direction movement motor) which moves the head carriage 42, the back surface thereof faces a like moving mechanism (X-direction movement stage 45, X-direction movement motor), and the upper surface thereof faces a not-shown component(s) which moves the ink cartridges. Hence, the exhaust vent 714 is formed in the right wall of the case body 71, the right wall not facing the mechanisms or components which hate dirt.

In the case body 71, the right half of a portion somewhat forward from the center in the front-back direction is isolated from the other space (ink retaining part 71*a* described below) of the case body 71 by three partition walls 712 which are vertically arranged in front of, behind and on the left of the right half of the portion.

The space enclosed by these three partition walls 712 and the right wall of the case body 71 is arranged so as to act as an obstruction between (i) the below-described ink introducing port 721 formed in the right front portion of the waste ink case 7 in a planar view and (ii) the exhaust vent 714. In this space, an H-shaped columnar wiping-member supporting part 713 is vertically arranged. To this wiping-member supporting part 713, the wiping member 75 (shown in FIG. 3) described below is attached.

The number, arrangement and so forth of the partition walls 712 are not particularly limited as long as the partition walls 712 are provided so as to act as an obstruction between the ink introducing port 721 and the exhaust vent 714 without making the ink introducing port 721 and the exhaust vent 714 completely incommunicable with each other. For example, only one partition wall 712 may be arranged between the ink introducing port 721 and the exhaust vent 714.

A portion of the case body 71, other than the space enclosed by the three partition walls 712 and the right wall of the case body 71, namely, a U-shaped portion in a planar view with the right side opened, is the ink retaining part 71*a* as a space where ink can be retained.

In the ink retaining part 71*a*, the ink absorber 73 which absorbs ink is housed. The ink absorber 73 can be formed of any material as long as it can absorb ink quickly. Examples thereof include a porous felt, and a spongy resin.

This ink absorber 73 is formed to be U-shaped in a planar view so as to correspond to the shape of the ink retaining part 71*a* in a planar view. More specifically, the ink absorber 73 is formed to be a shape of a front end part 731 and a main part 732 integrated with each other. The front end part 731 corresponds to the taper part 711, and the main part 732 is a part of the ink absorber 73, other than the front end part 731.

The main part 732 of the ink absorber 73 is formed to be approximately L-shaped in a planar view, wherein the left front end projects. The main part 732 is housed in a portion of the ink retaining part 71*a*, the portion not corresponding to the taper part 711. The main part 732 is formed to have a height with which the upper surface is positioned somewhat lower than the exhaust vent 714. The height of the main part 732 is not specifically limited as long as the main part 732 does not block at least the exhaust vent 714, and can ensure a predetermined ink absorbing amount.

Meanwhile, the front end part 731 of the ink absorber 73 is formed to be a flat plate which inclines to be higher at the front end to follow the taper part 711 of the case body 71. The front end part 731 is continuous with the front upper-end of the main part 732 in a state in which the front end part 731 is placed on the taper part 711.

The lid member 72 is formed to be approximately a flat plate and have a shape in a planar view corresponding to the shape of the case body 71 in a planar view.

In the right front-end portion of the lid member 72, the ink introducing port 721 is formed. Through the ink introducing port 721, ink ejected from the ink ejection surface 411 is introduced into the waste ink case 7 (inner space 7*a* described below). The ink introducing port 721 is formed to be long in the front-back direction and somewhat larger than the ink ejection surface 411. Around the ink introducing port 721, an ink flying prevention wall 721*a* which prevents ink from flying is vertically arranged.

In the lid member 72, to be specific, in a portion somewhat forward from the center in the front-back direction and somewhat rightward from the center in the right-left direction of the lid member 72, an opening part 722 is formed. The opening part 722 corresponds to the portion enclosed by the right wall and the three partition walls 712 of the case body 71.

Into the opening part 722, the wiping-member supporting part 713 of the case body 71 is inserted so as to be exposed upward, and to the head (upper end) of the wiping-member supporting part 713, the base end of the wiping member 75 is detachably attached as shown in FIG. 2 and FIG. 3.

The wiping member 75 has a plurality of wiping pieces 75*a* vertically arranged from the base end, and in this embodiment, has four wiping pieces 75*a* arranged in a houndstooth check, thereby being arranged at different positions. The arrangement, size, number and so forth of the wiping pieces 75*a* to be provided are not particularly limited.

Each wiping piece 75*a* is a cleaning blade which wipes ink and so forth adhered to the ink ejection surface 411, and formed of, for example, an elastic substance, such as gum. Preferably, the wiping pieces 75*a* are formed of a corrosive-resistant material which hardly corrodes or the like even if it repeatedly touches ink.

The wiping pieces 75*a* are plate-like members flattened in a direction (right-left direction, in this embodiment) which intersects at right angles to the moving direction of the drawing head 41, and arranged at positions and with a height at and with which the heads (upper ends) of the wiping pieces 75*a* contact the ink ejection surface 411 when the drawing head 41 passes over the wiping pieces 75*a*. The wiping pieces 75*a* flexibly warp according to the degree of the contact with the drawing head 41, and can remove the ink and so forth adhered to the ink ejection surface 411 by slidingly contacting the ink ejection surface 411 with their heads. Since the wiping member 75 is attached on the waste ink case 7, after performing the purging process of forcibly ejecting ink from the ink ejection surface 411 into the waste ink case 7, it is possible to efficiently perform the wiping process of wiping the ink ejection surface 411 with the wiping member 75, by moving the head carriage 42 backward along the Y direction.

Further, as shown in FIG. 2 and FIG. 3, the scraping unit 76 is detachably attached to the upper surface of the lid member 72. The scraping unit 76 removes the ink which adheres to the wiping pieces 75*a* as the wiping pieces 75*a* wipe the ink ejection surface 411.

The scraping unit 76 is movable in the front-back direction behind the ink introducing port 721, along two guide rails 723 arranged on the upper surface of the lid member 72. At the front end of the scraping unit 76, a scraping member 761 is arranged. The scraping member 761 scrapes the ink off the heads and so forth of the wiping pieces 75*a* by slidingly contacting the wiping pieces 75*a*.

On the upper surface of the scraping unit 76, a thin plate-like coupling spring 762 which has a mountain-folded bent part at the front end is arranged. The bent part at the front end of the coupling spring 762 is fitted into a not-shown concave part arranged on the lower surface of the head carriage 42, so that the scraping unit 76 is coupled to the head carriage 42 in a disengageable manner.

That is, by moving the head carriage 42 along the Y direction to above the scraping unit 76, the bent part of the coupling spring 762 is fitted into the concave part of the head carriage 42, so that the scraping unit 76 and the head carriage 42 are coupled to each other. By moving the head carriage 42 in this coupled state, the scraping unit 76 can be moved to the position at which the scraping unit 76 can scrape the wiping pieces 75*a*.

When the scraping unit 76 passes over the wiping pieces 75*a* from behind, the scraping unit 76 hits the ink flying prevention wall 721*a* arranged around the ink introducing port 721, so that the bent part of the coupling spring 762 drops (i.e., is disengaged) from the concave part of the head carriage 42. Thus the scraping unit 76 and the head carriage 42 are decoupled from each other. The scraping unit 76 is energized backward by a not-shown energizing spring, and hence when decoupled from the head carriage 42, sent back to its initial position (position at the back end of the upper surface of the lid member 72, in this embodiment) by the energizing force of the energizing spring.

As shown in FIG. 6A and FIG. 6B, the opening in the upper surface of the case body 71 is covered with the lid member 72, so that the inner space 7*a* of the waste ink case 7 is constructed. The inner space 7*a* is formed by the lid member 72 covering over the ink retaining part 71*a* of the case body 71.

The inner space 7*a* of the waste ink case 7 is the space where ink can be retained in the waste ink case 7, and only the ink introducing port 721 and the exhaust vent 714 communicate with the outside.

In the inner space 7*a* of the waste ink case 7, the ink absorber 73 is housed in the lower space, and the space over the ink absorber 73 forms a ventilation passage 7*b*.

The ventilation passage 7*b* is a passage for flowed-in air blown from the drawing head 41 with ink to pass through. More specifically, the ventilation passage 7*b* of this embodiment is, in a planar view and as indicated by arrows in FIG. 6A and FIG. 6B, a route from the ink introducing port 721 at the right front end of the waste ink case 7 to the exhaust vent 714 at the back end of the right wall, detouring, by turning to the left, the space isolated from the inner space 7*a* (ventilation passage 7*b*) by the three partition walls 712.

When ink is ejected from the ink ejection surface 411 of the drawing head 41 into the inner space 7*a*, the ink is absorbed by the ink absorber 73 while flowing from the ink introducing port 721 backward by following the slope of the front end part 731 of the ink absorber 73, and also flowing leftward due to the flow of the flowed-in air along the ventilation passage 7*b*. The ink included in the flowed-in air is absorbed by the ink absorber 73 arranged under the ventilation passage 7*b* while flowing along the ventilation passage 7*b* with the air.

Thus, in the inner space 7*a*, the ink absorber 73 is arranged along the ventilation passage 7*b* so as to cover the full length of the ventilation passage 7*b*. Consequently, the air including the ink ejected from the drawing head 41 is in contact with the ink absorber 73 over a long distance, and hence the ink absorber 73 properly absorbs the ink, as compared with an ink absorber arranged at only a specific point in a waste ink case.

Further, the ink included in the air flowing in the ventilation passage 7*b* is heavier than the air, and hence is properly absorbed by the ink absorber 73 arranged under the ventilation passage 7*b*.

Of the ventilation passage 7*b*, a portion having the minimum cross section (portion between the left wall and the partition wall 712 of the case body 71 in a planar view, in this embodiment) which is approximately at right angles to the ventilation direction is formed to have the cross section equivalent (80 to 100%, in this embodiment) to the area of the ink introducing port 721. Further, as described above, the exhaust vent 714 is also formed to have an area equivalent to the area of the ink introducing port 721. Consequently, there is no point where pressure loss is particularly large over the full length of the ventilation passage 7*b* including the exhaust vent 714, and hence the air can properly flow in and pass through the ventilation passage 7*b*.

Further, it is preferable that the ventilation passage 7*b* be formed to have the cross section of a predetermined size or larger which is not too small with respect to the amount of the flowed-in air. This can properly slow down the flowed-in air.

Further, it is preferable that the ventilation passage 7*b* be formed as a gentle flow passage not having a sharp turn exceeding an angle of 90°. For example, in this embodiment, the corner at the left front end of the ventilation passage 7*b* is formed so as to be chamfered in a planar view, thereby being curved gradually. Consequently, the air in the ventilation passage 7*b* can properly flow without detention.

As described above, according to this embodiment, the ink absorber 73 housed in the waste ink case 7 is provided along the ventilation passage 7*b* from the ink introducing port 721 through which ink is introduced inside to the exhaust vent 714 through which the air inside is exhausted.

Consequently, the air including the ink ejected from the drawing head 41 is in contact with the ink absorber 73 over a long distance, and hence the ink absorber 73 can properly absorb the ink, as compared with an ink absorber provided at only a specific point in a container.

Further, in the waste ink case 7, the space enclosed by the partition walls 712 acts as an obstruction between the ink introducing port 721 and the exhaust vent 714, and the ventilation passage 7*b* is a route from the ink introducing port 721 to the exhaust vent 714, detouring around the space enclosed by the partition walls 712.

This can ensure the length of the ventilation passage 7*b*, and, by extension, can sufficiently slow down the air flowed in when the ink is ejected, and also can make the ink absorber 73 properly absorb the ink, as compared with no partition wall 712 provided.

Further, the partition walls 712 define the space isolated from the ventilation passage 7*b*, and in this space, the wiping-member supporting part 713 which supports the wiping member 75 (wiping pieces 75*a*) that wipes the ink ejection surface 411 of the drawing head 41 is provided, the wiping member 75 being detachably attached to the wiping-member supporting part 713.

That is, the wiping member 75 and the waste ink case 7, which require regular maintenance, are configured to be integrated with each other. Consequently, maintenance of these can be performed simultaneously, and accordingly maintainability can be improved.

Further, the scraping unit 76 which removes the ink adhered to the wiping member 75 is detachably attached to the lid member 72. Consequently, maintenance of the scraping unit 76 and the waste ink case 7 can also be performed simultaneously, and accordingly maintainability can be further improved.

Further, (i) of the ventilation passage 7*b*, a portion having the minimum cross section which is substantially at right angles to the ventilation direction and (ii) the exhaust vent 714 are formed to have the cross section and an area, respectively, equivalent to the area of the ink introducing port 721.

Consequently, there is no point where pressure loss is particularly large over the full length of the ventilation passage 7*b* including the exhaust vent 714, and hence the air can properly flow in and pass through the ventilation passage 7*b*.

Further, the ventilation passage 7*b* is formed not to have a turn exceeding an angle of 90°. Consequently, the air in the ventilation passage 7*b* can properly flow without detention.

Further, in the waste ink case 7, the ink absorber 73 is housed in the lower space of the inner space 7*a* where ink can be retained, and the ventilation passage 7*b* is formed over the ink absorber 73.

Consequently, the ink, which is heavier than the air, can be properly absorbed by the ink absorber 73 provided under the ventilation passage 7*b*.

Further, the partition plate 8 is vertically provided so as to cover the exhaust vent 714, having a gap between the partition plate 8 and the exhaust vent 714. This can prevent ink mist from flying apart even if the ink mist is released through the exhaust vent 714.

Further, the moving mechanisms which move the drawing head 41 are provided at positions which face surfaces (left surface and back surface, in this embodiment) of the waste ink case 7, the surfaces where the exhaust vent 714 is not formed.

This can prevent the moving mechanisms from getting dirty by the ink mist released through the exhaust vent 714, and, by extension, can suppress occurrence of malfunctioning of the moving mechanisms.

In the above, the embodiment(s) of the present invention has been described. Needless to say, however, the present invention is not limited to the embodiment, and can be modified in a variety of respects without departing from the scope of the present invention.

For example, in the embodiment, the ink absorber 73 is arranged in the lower space of the inner space 7*a* in the waste ink case 7, but not limited thereto as long as it is arranged along the ventilation passage 7*b*.

Further, in the embodiment, the ventilation passage 7*b* is a route from the ink introducing port 721 at the right front end of the waste ink case 7 to the exhaust vent 714 at the back end of the right wall thereof. However, the route, length and so forth of the ventilation passage 7*b* are not particularly limited, and the route may extend in a vertical plane or an inclined plane.

Further, in the embodiment, the waste ink case 7 is provided with the wiping member 75 and the scraping unit 76. However, the waste ink case 7 may not be provided with the wiping member 75 or the scraping unit 76, or may be provided with another maintenance unit.

As another maintenance unit, there may be provided a unit which absorbs and thereby removes the ink and so forth adhered to the ink ejection surface 411 by pressing an absorbing member formed of a high-absorbent material, such as a felt, to the ink ejection surface 411.

In the above, one or more embodiments of the present invention have been described. However, the scope of the present invention is not limited thereto, and includes the scope of claims below and the scope of their equivalents.

What is claimed is:

1. A waste ink case comprising:

a container which houses an ink absorber that absorbs an ink, the container including:

an ink introducing port through which the ink is introduced from a print head into the container;

an exhaust vent through which an air in the container is exhausted; and a partition wall which acts as an obstruction between the ink introducing port and the exhaust vent, wherein the ink absorber is provided along a ventilation passage from the ink introducing port to the exhaust vent, detouring around the partition wall, wherein the partition wall defines a space isolated from the ventilation passage, and wherein, in the space, a wiping-member supporting part which supports a wiping member that wipes an ink ejection surface of the print head is provided, the wiping member being detachably attached to the wiping-member supporting part.

2. The waste ink case according to claim 1, wherein a scraping unit which removes ink adhered to the wiping member is detachably attached to the container.

3. The waste ink case according to claim 1, wherein each of (i) an area of a cross section of a portion of the ventilation passage having a minimum cross section which is approximately at right angles to a ventilation direction and (ii) an area of the exhaust vent is substantially equivalent to an area of the ink introducing port.

4. The waste ink case according to claim 1, wherein the ventilation passage does not have a turn exceeding an angle of 90°.

5. The waste ink case according to claim 1, wherein in the container, the ink absorber is housed in a lower space of a space where the ink can be retained, and the ventilation passage is formed over the ink absorber.

6. A printer comprising:

a waste ink case including:

a container which houses an ink absorber that absorbs an ink, the container including:

an ink introducing port through which the ink is introduced from a print head into the container;

an exhaust vent through which an air in the container is exhausted; and a partition wall which acts as an obstruction between the ink introducing port and the exhaust vent; and a partition plate vertically provided so as to cover the exhaust vent with a gap between the partition plate and the exhaust vent, wherein the ink absorber is provided along a ventilation passage from the ink introducing port to the exhaust vent, detouring around the partition wall, wherein the partition wall defines a space isolated from the ventilation passage, and wherein, in the space, a wiping-member supporting part which supports a wiping member that wipes an ink ejection surface of the print head is provided, the wiping member being detachably attached to the wiping-member supporting part.

7. The printer according to claim 6, further comprising:

the print head; and a moving mechanism which moves the print head, wherein the moving mechanism is provided at a position which faces a surface of the waste ink case where the exhaust vent is not formed.

8. The printer according to claim 7, further comprising the wiping member, wherein, after the print head ejects ink from the ink ejection surface, the moving mechanism moves the print head to the wiping member.

* * * * *